US010537775B1

(12) United States Patent
Davis et al.

(10) Patent No.: US 10,537,775 B1
(45) Date of Patent: Jan. 21, 2020

(54) FLEXIBLE IMPLEMENT GRIP WITH INTERIOR TEXTURE

(71) Applicant: Eaton Intelligent Power Limited, Dublin (IE)

(72) Inventors: Stephen James Davis, Pinehurst, NC (US); Edward Wang, Tainan (TW)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/106,169

(22) Filed: Aug. 21, 2018

(51) Int. Cl.

| | |
|---|---|
| ***A63B 60/08*** | (2015.01) |
| ***A63B 53/14*** | (2015.01) |
| ***A63B 60/14*** | (2015.01) |
| ***A63B 102/32*** | (2015.01) |

(52) U.S. Cl.
CPC ..... *A63B 60/08* (2015.10); *A63B 53/14* (2013.01); *A63B 60/14* (2015.10); *A63B 2102/32* (2015.10); *A63B 2209/00* (2013.01)

(58) Field of Classification Search
CPC ..... A63B 60/08; A63B 60/14; A63B 53/14; A63B 2102/32; A63B 2209/00
See application file for complete search history.

(56) References Cited

U.S. PATENT DOCUMENTS

| | | | | |
|---|---|---|---|---|
| 2,704,668 | A * | 3/1955 | Park | A63B 53/14 473/300 |
| 4,919,420 | A * | 4/1990 | Sato | A63B 53/14 473/203 |
| 6,696,629 | B1 | 2/2004 | Wallace et al. | |
| 7,048,644 | B2 | 5/2006 | Wang | |
| D593,172 | S | 5/2009 | Gill et al. | |
| D629,857 | S | 12/2010 | Gill et al. | |
| D644,285 | S | 8/2011 | Gill et al. | |
| 8,006,349 | B2 | 8/2011 | Gill | |
| 8,296,907 | B2 | 10/2012 | Gill et al. | |
| 8,334,337 | B2 | 12/2012 | Lamkin et al. | |
| D691,682 | S | 10/2013 | Su et al. | |
| 2009/0011875 | A1* | 1/2009 | Drake | A63B 49/08 473/551 |
| 2012/0283052 | A1* | 11/2012 | Tucker, Jr. | A63B 60/14 473/513 |
| 2016/0030822 | A1* | 2/2016 | Cartagena, Jr. | A63B 69/36 473/458 |
| 2017/0080309 | A1* | 3/2017 | Barker | A63B 60/14 |

* cited by examiner

*Primary Examiner* — Jeffrey S Vanderveen
(74) *Attorney, Agent, or Firm* — Fay Sharpe LLP

(57) ABSTRACT

The present disclosure thus provides a unique flexible elastomeric grip for an implement handle such as a shaft of a golf club and has a pattern of voids/recesses in the form of grooves and/or dimples on the inner periphery thereof which may be spaced to provide different cushioning in longitudinally spaced regions of the grip. Where texture grooves are employed on the outer periphery of the grip of the present disclosure, the thickness of the material between the grooves and/or dimples on the inner periphery and the texture on the outer periphery is maintained at not less than one millimeter (1 mm).

12 Claims, 3 Drawing Sheets

FLEXIBLE IMPLEMENT GRIP WITH INTERIOR TEXTURE

BACKGROUND

The present disclosure relates to flexible grips for the handles of implements intended to be swung with speed and force such as for example, hammers, axes, and sporting implements such as tennis racquets and golf clubs. The present disclosure particularly relates to such flexible grips for golf clubs where the market trend is toward lighter weight grips and for ways to provide softer, better impact absorbing qualities to the grip.

Because most implement grips, and particularly golf club grips, are made of elastomeric material, it has been found difficult to reduce the weight of the grip by reducing the density of the elastomeric material. Heretofore, fillers and microspheres have been employed in attempts to reduce the weight of the grip; however, these tend to reduce the abrasion resistance and strength of the elastomer. Attempts have also been made to improve the cushioning of the grip by lowering the durometer of the elastomeric material; however, this has resulted in compression set and undesirable reduction in the size of the grip. Furthermore, it is possible for tournament rules for golf to prohibit grips exhibiting permanent deformation.

Heretofore, attempts also have been made to reduce the weight of elastomeric implement grips, particularly golf club grips, by employing a foam spacer between the core and cover of the grip to reduce weight. However, this has resulted in increased difficulty in manufacturing and has been found to be not cost-effective for high volume production.

Additionally, it has been found desirable for marketability to vary the weight, feel and cushioning of the grip locally in certain regions or areas of the grip. Existing golf club grips have been provided with a textured exterior surface which may be formed by dimples resulting from small recesses and grooves in order to provide enhanced traction and firmness near the butt end of the grip and a lesser texture and less firmness in other areas of the grip. Example of such prior art grips are shown in FIG. 1, where a portion of a flexible grip 1 has an open end 2 adapted for being received over an implement handle such as the shaft of a golf club, shown in dashed line 3. The outer surface 1 has spiral texture grooves 4 and texture dimples 5. However, these techniques have been limited in their effectiveness of reducing weight and providing improved cushioning or impact absorption of the grip. As a result of the minimum surface area of contact from the user's hand on the exterior surface of a grip, an exterior surface that has a high concentration of dimples and recesses is not comfortable to the user, particularly on a golf club.

Attempts have also been made to reduce vibrations from impact by employing bands of closely spaced circumferential grooves on the interior surface of the flexible grip 7 as shown in FIG. 2 and described in U.S. Pat. No. 7,048,644.

Thus, it has been desirable to provide a way or means of improving the cushioning and impact absorbing abilities of a flexible elastomeric grip and also to reduce the overall weight of the grip independent of the exterior modifications.

SUMMARY

The present disclosure addresses the above-described problem of reducing the weight and improving the cushioning and impact absorbing capabilities of a flexible implement grip, particularly a golf club grip, in a manner which may be employed cost-effectively in high volume production.

The flexible grip of the present disclosure employs textured surfaces on the exterior surface of the grip which textured surfaces may vary along the length of the grip. Additionally, the present grip has recesses or voids formed on the inner periphery of the grip in a manner which maintains a desired minimum amount of material between the inner periphery and the outer textured surface of the grip.

In one version, the flexible grip of the present disclosure has formed on the inner periphery thereof a plurality of grooves, oriented at a bias angle with respect to the longitudinal axis of the grip, and which may vary in width and depth along the length of the grip to vary the contact area of the inner periphery with the shaft or handle of the implement to thereby provide for increased cushioning or impact absorbing qualities. These grooves may be varied in width and depth, thereby provide for varying the cushioning along the length of the grip.

In another version, the grooves on the inner periphery may be formed in a spiral arrangement or helical configuration; and, the interior grooves may have different configurations in cross-section, such as square, beveled, or radiused.

In another version, recessed dimples are formed on the inner periphery of the tubular grip to thereby provide improved cushioning of the grip.

In another version, the inner periphery has a combination of dimples and bias angled grooves to provide improved cushioning.

In another version of the flexible grip of the present disclosure, the interior grooves are arranged to form in cooperation with the textured grooves on the exterior, a staggered or 'waffle' configuration to grip. The 'waffle' configuration of the flexible grip of the present disclosure has been found to provide a weight reduction in the amount of five percent (5%) as compared to a grip without the interior grooves.

DETAILED DESCRIPTION

Figure 1:
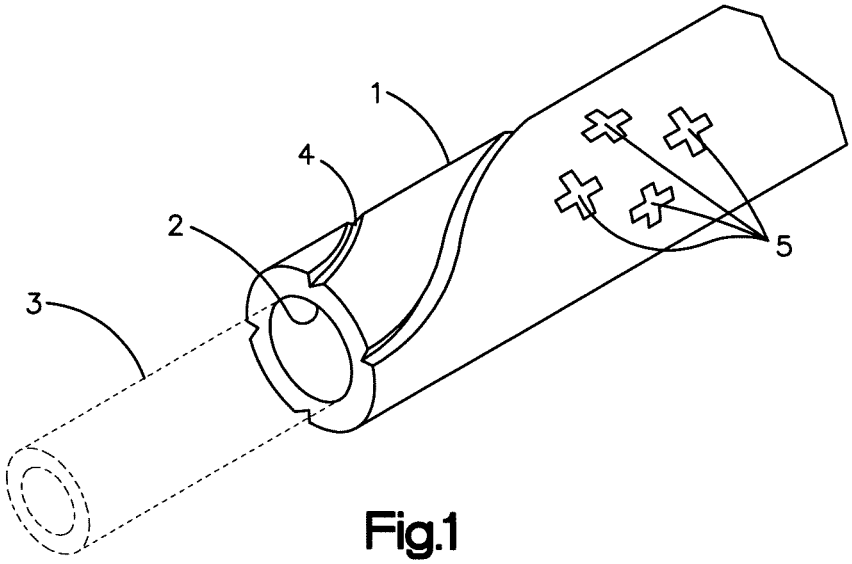
Fig.1 PRIOR ART
FIG. 1 is an isometric view of a portion of a prior art golf grip showing exterior texture in the form of grooves and dimples.
Figure 2:
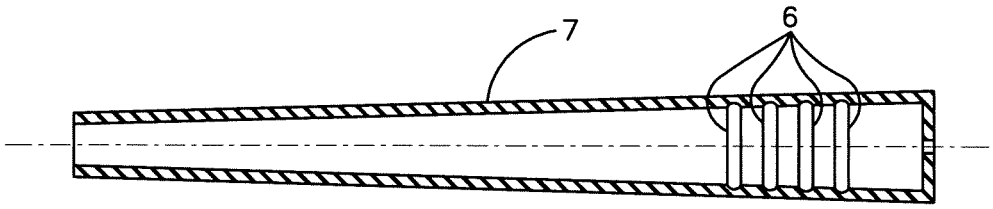
Fig.2 PRIOR ART
FIG. 2 is a longitudinal section view of a prior art golf grip with closely spaced circumferential grooves on the inner periphery.
Figure 3:
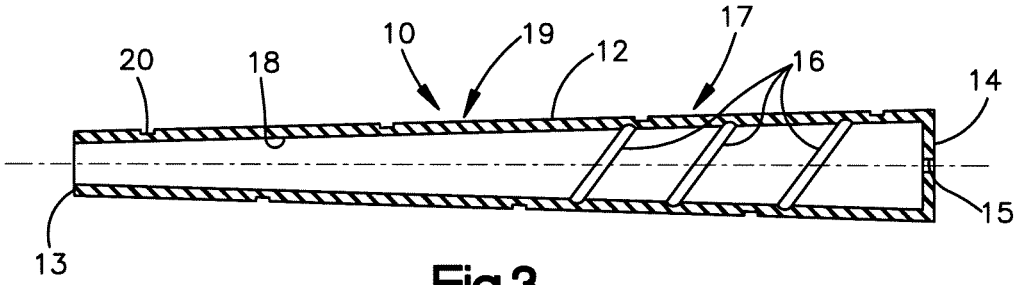
FIG. 3 is a longitudinal section view of a golf grip of the present disclosure showing a version having bias angled interior grooves.

Referring to FIG. 3, one version of the flexible grip of the present disclosure is illustrated generally at 10 in cross section and has a tubular member 12 formed of elastomeric material as, for example, an elastomer having a durometer hardness in the range of 30-80 on the Shore "A" scale, and has an open end 13 and an oppositely disclosed closed end 14 as shown with a vent port 15 and is adapted for being received over the handle of an implement such as the shaft of a golf club (not shown). The grip 10 has on the inner periphery thereof at least one, and as shown in FIG. 3, a plurality of spaced grooves 16 formed circumferentially about the inner periphery 18 of the grip 10; and, the circumferential grooves 16 are disposed at a bias angle with respect to the longitudinal axis of the grip 10 in a generally spaced parallel arrangement. However, alternatively, the grooves may comprise a continuous spiral groove.

In the present practice, it has been found satisfactory to have such a spiral groove have a first axial pitch in a first longitudinal zone of the grip and a second axial pitch in a second longitudinally distinct zone which differs from the first spiral pitch by at least ten degrees (10°).

In the present practice, with reference to FIG. 3, it has been found satisfactory for a golf club grip, having a tubular member 12 with open end 13 and opposite closed end 14 as shown with vent port 15 to have the recesses/voids which, in the embodiment of FIG. 3, comprise a pattern, having bias angle grooves 16 disposed on inner periphery 18 spaced to provide a first annular region indicated generally at 17 having a first rate of cushioning and a second annular region indicated generally at 19, having a second rate of cushioning differing from the first rate of cushioning by at least ten percent (10%). In the present practice, it has been found satisfactory to form the grooves 16 to a depth in the range 0.5 to 4 mm and a width in the range 0.5 to 6 mm with a wall thickness in the range of 2 to 7 mm. In the present practice, one version of the grip of the present disclosure, the grooves have a depth in the range 1.0 to 2.0 mm and a width in the range 1.0 to 3.0 mm; however, other depths and widths may be employed depending upon the thickness of the tubular member 12, and the amount of desired cushioning.

If desired, exterior texture grooves shown as a spiral groove 20 may optionally be formed on the exterior of the grip. If such exterior texture grooves 20 are employed, it has been found satisfactory to have the thickness of material between the external texture grooves 20 and the interior grooves 16 not less than one millimeter (1 mm).

Figure 4:
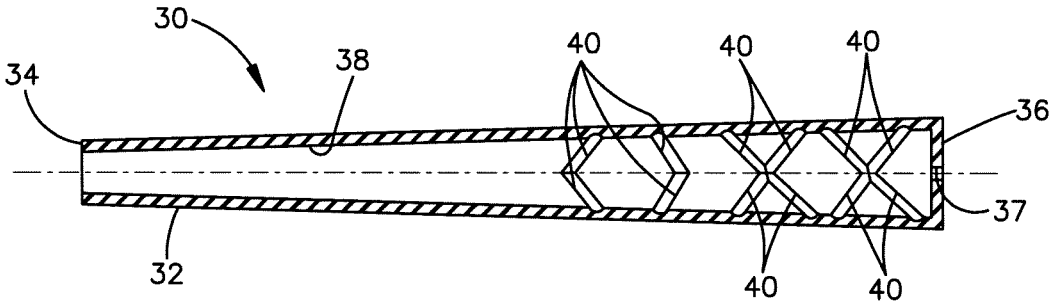
FIG. 4 is a longitudinal section view of a golf grip of the present disclosure showing another version having intersecting interior grooves disposed in different bias angles.

Referring to FIG. 4, another version of the flexible grip of the present disclosure is indicated generally at 30 and comprises a tubular member 32 of elastomeric material having an open end 34 and an oppositely disposed end thereof closed as shown with a vent port at 36, as shown with a vent port 37. The tubular member 32 has formed on the inner periphery 38 thereof at least one, and in the version shown in FIG. 4, a plurality of recesses or voids comprising grooves 40 formed at a bias angle with respect to the longitudinal axis of the grip 30. In the version shown in FIG. 4, certain ones of the grooves 40 are disposed at a first bias angle and others at second bias angles opposite the first bias angles so that the grooves intersect. The grooves 40 function to provide improved cushioning of the flexible grip upon being gripped by the user.

Figure 5:
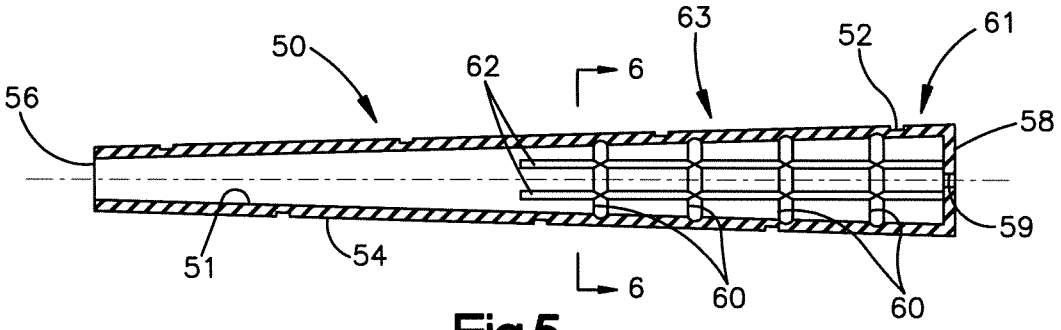
FIG. 5 is a longitudinal section view of a golf grip of the present disclosure showing another version having interior circumferential and longitudinal grooves that intersect.
Figure 6:
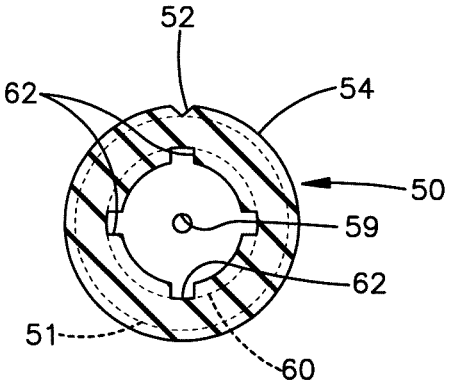
FIG. 6 is a transverse cross-sectional view of a golf grip of FIG. 5 showing exterior grooves and interior grooves.

Referring to FIGS. 5 and 6, another version of the flexible grip of the present disclosure is illustrated in longitudinal cross-section indicated generally at 50 and may have texture grooves such as the spiral groove 52 on the outer surface thereof. The grip 50 comprises a tubular member 54 of elastomeric material wherein the grip has an open end 56 adapted for being received over the handle of an implement such as the shaft of a golf club and a closed end 58 with vent port 59 opposite open end 56. The tubular member 54 has provided on the inner periphery 51 thereof at least one, and in the embodiment of FIG. 5, a plurality of circumferentially formed longitudinally spaced circumferential grooves 60. The spacing of the grooves 60 may be varied so as to provide different cushioning of the elastomeric material in different longitudinal regions indicated generally at 61, 63 of the grip.

The version of FIG. 5 also has provided on the inner periphery 51 at least one, and as shown in the version of FIG. 5, a plurality of longitudinally extending circumferentially spaced generally parallel grooves 62 which intersect the circumferential grooves 60. Alternatively, although not shown in FIG. 5, either or both of the interior grooves 60, 62 may be formed at a bias angle.

In the version shown in FIG. 5, the interaction of the interior grooves 60 and the interior grooves 62 thus provides a somewhat 'waffle-like' configuration on the inner periphery 51. In the present practice, it has been found satisfactory to have the thickness of the elastomeric material in the regions between the interior grooves and the exterior texture grooves 52 maintained as not less than one millimeter (1 mm).

Figure 7:
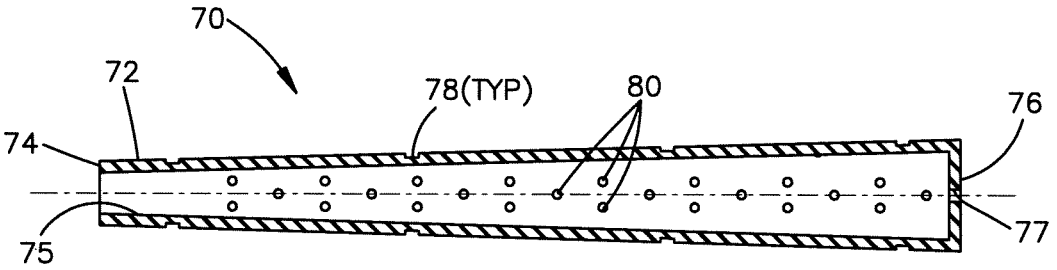
FIG. 7 is a longitudinal cross-sectional view of a golf grip of the present disclosure showing another version having recessed dimples on the interior surface.

Referring to FIG. 7, another version of the flexible grip of the present disclosure is indicated generally at 70 and comprises a tubular elastomeric member 72 having an open end 74 with an oppositely disposed closed end 76 as shown with a vent port 77. The grip of FIG. 7 employs texture grooves on the exterior surface or outer periphery thereof and illustrated in FIG. 7 as the spiral groove 78. The tubular member 72 has provided thereon a pattern of dimples 80 formed on the inner periphery to provide improved cushioning or compressibility to the grip and are illustrated in FIG. 7 as a combination of circular and diamond configurations. Alternatively, the recessed dimples 80 may have elliptical, oval, or polygonal configurations. The depth of the dimples 80 in the present practice is controlled to maintain the thickness of the material between the dimples 80 and the exterior groove 78 at not less than one millimeter (1 mm).

Figure 8:
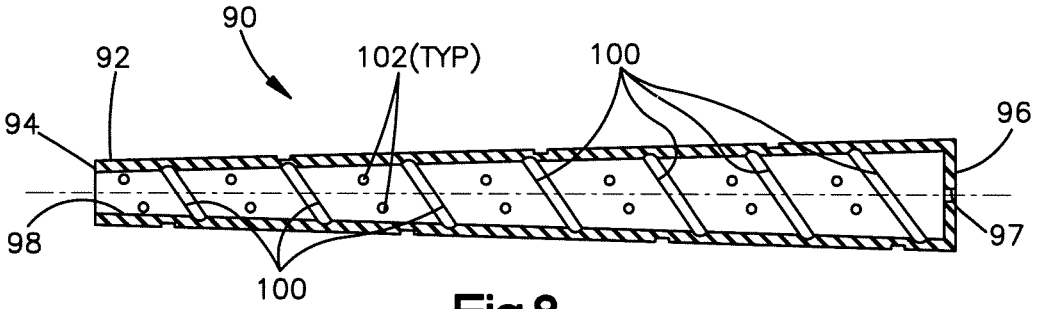
FIG. 8 is a longitudinal cross sectional view of a golf grip of the present disclosure showing another version having recessed dimples and bias angled grooves on the interior surface.

Referring to FIG. 8, another version of the flexible grip of the present disclosure shown at 90 comprises a tubular member 92 of elastomeric material having an open end 94 and a closed end 96 as shown with a vent port 97 opposite end 94. The inner periphery 98 has at least one, and in the version shown, a plurality of recessed dimples 102 formed therein and interspersed in the spacing between the grooves 100 and in a pattern generally making the bias angle with the longitudinal axis of the tubular member. Alternatively, oppositely bias angled intersecting grooves may be employed with recessed dimples therebetween (although not shown in FIG. 8), if desired.

The present disclosure describes a flexible elastomeric grip for an implement handle, particularly for a golf club shaft having improved "cushioning" or compressibility upon being gripped by the user. The tubular grip utilizes a pattern of voids/recesses comprising grooves and/or recessed dimples of varying depth and width of the inner periphery to provide regions along the grip with varying cushioning properties. The grip having grooves and/or dimples may also have a pattern of exterior texture grooves in which the material thickness between the inner grooves and/or dimples and the exterior texture grooves is maintained at not less than one millimeter (1 mm).

The exemplary embodiment has been described and illustrated with reference to the drawings. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. In a flexible grip for a golf club shaft, an improvement comprising:

a tubular member formed of elastomeric material having a closed end and an open end adapted for being received over the shaft, wherein the inner periphery of the tubular member has recesses including a plurality of bias angle grooves, operative to provide a first angular region having a first rate of cushioning and a second annular region having a second rate of cushioning different from the first rate of cushioning by at least ten percent (10%).

2. The improvement of claim 1, wherein the grooves in the inner periphery are disposed to form a waffle-like pattern.

3. The improvement of claim 1, further comprising a pattern of recessed dimples.

4. The improvement of claim 1, wherein the pattern of recesses includes a pattern of intersecting bias angled grooves.

5. The improvement of claim 1, further comprising a pattern of textured surfaces on the outer periphery of the tubular member.

6. The flexible grip of claim 1, wherein the plurality of grooves has one of (i) depth and (ii) width vary along the length of the grip.

7. In a flexible grip for a golf club shaft, an improvement comprising:

(a) a tubular member formed of elastomeric material having a closed end and an open end adapted for being received on the shaft, wherein the inner periphery of the tubular member has a plurality of grooves formed therein defining:

(i) a first annular region extending axially a predetermined distance along a first longitudinal portion of the grip, the first annular region having the grooves configured in a first pattern and depth; and (ii) a second annular region extending axially a predetermined distance along a second longitudinal portion of the grip, the second annular region having the recesses configured in a second pattern and depth; and (b) a plurality of texture grooves formed on the outer periphery of the tubular member, wherein the recesses in the first annular region cooperate with the texture grooves to provide a first rate of cushioning in the first annular region, and the recesses in the second annular region cooperate with the texture grooves to provide a second rate of cushioning differing from the first rate of cushioning by at least ten percent (10%) in the second annular region wherein the thickness of elastomeric material therebetween is maintained not less than one millimeter (1 mm).

8. The improvement of claim 7, wherein the texture grooves in the outer periphery are disposed in staggered arrangement with respect to the recesses in the inner periphery without intersecting the first and second pattern.

9. In a flexible grip for a golf club shaft, an improvement comprising:

a tubular member formed of elastomeric material having a closed end and an open end adapted for being received over the shaft, wherein the inner periphery of the tubular member has recesses including at least one groove extending at a bias angle to the longitudinal axis of the tubular member, wherein the at least one groove extending at a bias angle to the longitudinal axis of the tubular member includes a series of spiral grooves having a first axial pitch in a first zone and a second axial pitch in a second zone which differs from the first axial pitch by at least ten degrees (10°).

10. In a flexible grip for a golf club shaft, an improvement comprising:

a tubular member formed of elastomeric material having a closed end and an open end adapted for being received over the shaft, wherein the inner periphery of the tubular member has recesses including at least one groove extending at a bias angle to the longitudinal axis of the tubular member further comprising a pattern of textured recesses on the exterior surface of the tubular member wherein the thickness of the elastomeric material between the external pattern of textured recesses and a textured pattern of recesses on the inner periphery is not less than one millimeter (1 mm).

11. A flexible grip for a golf club shaft comprising:

a tubular member formed of elastomeric material having a closed end and an open end with an inner periphery adapted for being received on the shaft of the club, wherein the inner periphery of the tubular member has a pattern of recesses/voids formed therein, and the outer periphery has a plurality of texture grooves formed therein, wherein the pattern of recesses/voids on the inner is disposed in staggered arrangement with respect to the texture grooves for providing a desired rate of cushioning, wherein the thickness of the elastomeric material between the pattern of recesses and the texture grooves is maintained not less than one millimeter (1 mm) wherein the pattern of recesses/voids is disposed to provide a first annular region having a first rate of cushioning and a second annular region having a second rate of cushioning differing from the first rate of cushioning by at least ten percent (10%).

12. In a flexible grip for a golf club shaft, an improvement comprising:

a tubular member formed of elastomeric material having a closed end and an open end adapted for being received over a golf club shaft wherein the inner periphery of the tubular member has a plurality of axially spaced circumferential grooves and a plurality of circumferentially spaced axially extending grooves intersecting the circumferential grooves forming a waffle-like pattern operative for providing a desired amount/rate of cushioning when gripped by a user, wherein the thickness of the elastomeric material of the tubular member about the grooves is not less than one millimeter (1 mm).

* * * * *